US006100784A

United States Patent [19]

Hofsäss

[11] Patent Number: 6,100,784

[45] Date of Patent: Aug. 8, 2000

[54] TEMPERATURE-DEPENDENT SWITCH WITH CONTACT BRIDGE

[76] Inventor: Marcel Hofsäss, Höfener Strasse 29, 75305 Neuenbürg/Waldrennach, Germany

[21] Appl. No.: 09/025,281

[22] Filed: Feb. 18, 1998

[30] Foreign Application Priority Data

Jan. 3, 1997 [DE] Germany ..... 197 08 436

[51] Int. Cl.[7] ..... H01H 37/74; H01H 37/52; H01H 37/54

[52] U.S. Cl. ..... 337/343; 337/333; 337/36; 337/53; 337/89

[58] Field of Search ..... 337/14, 102, 103, 337/104, 16, 36, 97, 298, 333, 343, 377, 390, 53, 89

[56] References Cited

U.S. PATENT DOCUMENTS

| | | | |
|---|---|---|---|
| 2,707,738 | 5/1955 | Weissheimer et al. | 337/368 |
| 2,753,421 | 7/1956 | Mertler | 337/347 |
| 3,308,255 | 3/1967 | Faggiano | 337/367 |
| 3,496,511 | 1/1968 | Colavecchio | 337/343 |
| 4,476,452 | 10/1984 | D'Entremont | 337/102 |
| 4,581,509 | 4/1986 | Sanford et al. | 200/83 P |
| 4,620,175 | 10/1986 | Karr et al. . | |
| 4,862,132 | 8/1989 | Hollweck | 337/102 |
| 5,670,930 | 9/1997 | Hofsäss et al. . | |

FOREIGN PATENT DOCUMENTS

| | | |
|---|---|---|
| 0453596 | 10/1991 | European Pat. Off. . |
| 3122899 | 10/1984 | Germany . |
| 8801859 | 6/1988 | Germany . |
| 4139091 | 8/1993 | Germany . |
| 4337141 | 5/1995 | Germany . |
| 4141233 | 3/1996 | Germany . |
| 2239827 | 7/1991 | United Kingdom . |

*Primary Examiner*—Leo P. Picard
*Assistant Examiner*—Anatoly Vortman
*Attorney, Agent, or Firm*—Harness, Dickey & Pierce, P.L.C.

[57] ABSTRACT

A temperature-dependent switch (10) has a temperature-dependent switching mechanism (12) and a closed housing (11), receiving the switching mechanism (12), which comprises a lower part (14) as well as an upper part (17) made of insulating material. Two stationary contacts (26, 27) are provided on the upper part (17) on its inner side (28), each of which is electrically connected to an external terminal associated with it. Also provided is a current transfer member (29), moved by the switching mechanism (12), which electrically connects the two stationary contacts (26, 27) with one another as a function of temperature. Two connector electrodes (24, 25) are embedded into the upper part (17), each of which is connected to one of the stationary contacts (26, 27) and to one of the external terminals (38, 39).

7 Claims, 3 Drawing Sheets

TEMPERATURE-DEPENDENT SWITCH WITH CONTACT BRIDGE

BACKGROUND OF THE INVENTION

1. Field of the Invention

The present invention concerns a temperature-dependent switch having a temperature-dependent switching mechanism; a closed housing, containing the switching mechanism, which has a lower part as well as an upper part made of insulating material; two stationary contacts provided on the upper part on its inner side, each contact being electrically connected to an external terminal associated with it; and a current transfer member, actuated by the switching mechanism and electrically connecting the two stationary contacts with one another as a function of temperature.

2. Related Prior Art

A switch of this kind is known from DE 26 44 411 C2.

The known switch has a housing with a cup-shaped lower part into which a temperature-dependent switching mechanism is placed. The lower part is closed off by an upper part which is retained on the lower part by the elevated rim thereof. The lower part can be manufactured from metal or insulating material, while the upper part is in any event manufactured from insulating material.

Resting in the upper part are two rivets whose inner heads serve as stationary contacts for the switching mechanism. The switching mechanism carries a current transfer member in the form of a contact bridge, which as a function of temperature is brought into contact with the two stationary contacts and then electrically connects them to one another.

The external heads of the two rivets serve as solder terminals for leads.

The temperature-dependent switching mechanism has, in a manner known per se, a bimetallic disk as well as a spring disk which is penetrated centeredly by a pin which carries the contact bridge. The spring disk is guided peripherally in the housing, while the bimetallic disk is braced, depending on its temperature, against the floor of the lower part or against the rim of the spring disk, and thereby either allows the contact bridge to make contact with the two stationary contacts or lifts the contact bridge away from the stationary contacts so that the electrical connection between the external terminals is interrupted.

This temperature-dependent switch is used, in known fashion, to protect electrical devices from overheating. For this purpose, the switch is connected in series with the device to be protected, and is arranged mechanically on the device so that it is thermally coupled thereto. Below the response temperature of the bimetallic disk, the contact bridge rests against the two stationary contacts, so that the circuit is closed and the device to be protected is supplied with power. If the temperature rises above an allowable value, the bimetallic disk lifts the contact bridge away from the stationary contacts, so that the switch opens and the supply of power to the device to be protected is interrupted, so that the latter can cool off again.

Although the known switch technically meets all requirements, it still has a series of disadvantages which are associated with its production and its installation on a device to be protected.

One disadvantage is the complex manufacture of the known switch: after production of the cover, the rivets must still be subsequently mounted on it. A further disadvantage lies in the fact that leads must still be soldered onto the external rivets; this cannot, as a rule, be automated. This means, however, that the production of a switch that is equipped with leads and ready to be connected is in this case time-consuming and thus cost-intensive.

Further disadvantages are to be seen in conjunction with installation of the known switch on a device to be protected. The known switch has only solder terminals or leads, while crimp or screw terminals are often required today. If the lower part is manufactured of plastic, thermal coupling to the device to be protected is relatively poor with the known switch, while with a lower part manufactured of metal, although good thermal coupling can be achieved, the elevated metal rim of the lower part must often additionally be electrically insulated from the outside.

In summary, therefore, the disadvantages of the known switch are on the one hand complexity of manufacture and on the other hand the fact that capabilities for installation on a device to be protected are insufficient for many applications.

In this connection, a temperature-dependent switch having a lower housing part made of metal and an upper housing part made of insulating material is known from DE 31 22 899 C2. Embedded into the upper part are two connector tongues, the first of which is connected to a stationary contact arranged centeredly. The second connector tongue is equipped with tabs which, when the upper part is installed, are electrically connected to the lower part.

Arranged in the interior of the closed housing constituted in this fashion is a bimetallic switching mechanism which, as a function of its temperature, creates an electrically conductive connection between the stationary contact and the lower housing part and thus between the two connector tongues.

A disadvantage of this switch is that assembly, in particular the arrangement of the upper part on the lower part, is complicated, because the tabs configured integrally with the second connector tongue must, for the purpose, be oriented appropriately. If manufacturing errors or inaccuracies are present, the reliability of the electrical connection between the connector tab and the lower part is not guaranteed.

As was already the case with the switch mentioned at the outset, here again the elevated lower part made of metal requires lateral insulation for certain applications.

A further disadvantage of the known switch lies in the fact that the connector tongues project vertically upward out of the upper part, which interferes with installation on the device to be protected and, in particular, with electrical connection.

SUMMARY OF THE INVENTION

In view of the above, it is an object of the present invention to provide for a switch of the kind cited initially which is easy to produce and can easily be installed on a device to be protected.

In the case of the switch mentioned at the outset, this object is achieved, according to the invention, by the fact that two connector electrodes are embedded into the upper part, each of which is connected to one of the stationary contacts and to one of the external terminals.

A method according to the invention for producing a temperature-dependent switch of the type mentioned at the outset comprises the following steps:

a) preparing two connector electrodes, each of which is equipped with a stationary contact and an external terminal;

b) manufacturing the upper part while simultaneously embedding the two connector electrodes, in such a way that the stationary contacts lie on the inner side of the upper part;

c) placing the temperature-dependent switching mechanism into the housing; and d) fitting the upper part and lower part together.

The object underlying the invention is completely achieved in this fashion.

Specifically, the inventor of the present application has recognized that it is possible, with a switch of this kind, to embed into the upper part connector electrodes which connect the stationary contacts on the inner side of the upper part to external terminals outside the upper part. There is a particular advantage here in the production of the new switch, since the connector electrodes can, in a first step, be connected to stationary contacts and to the external terminals, whereupon when the upper part is injection molded, the connector electrodes are then, in a manner of speaking, embedded or insert molded.

In other words, during production of the upper part itself, the external terminals and the stationary contacts are simultaneously attached thereto. One particular advantage of the new switch and of the new method for its production thus lies in the fact that it is easy to produce.

A further advantage can be seen in the fact that by selecting the shape of the connector electrodes, the external terminals can now be adapted geometrically in any desired fashion to the stationary contacts; the external terminals themselves can now be configured as solder, crimp, or screw terminals.

A further advantage of the new switch can thus be seen in the fact that it can be installed much more easily on devices to be protected, since the particular connector technology required for the device can be provided.

In a development of the new switch, it is preferred if each connector electrode is a flat metal part with which the respective external terminal, which preferably projects laterally from the upper part, is configured integrally, such that in addition, the connector electrodes preferably lie parallel to one another in the upper part.

The advantage here is that additional connections can readily be made to the external terminals located "next to" the switch, so that installation of the new switch on the device to be protected is simplified.

Furthermore the new switch is also easy to manufacture: the connector electrodes can be, for example, belt-mounted or delivered on a strip; and they moreover result in good stability for the upper part since they are metal parts configured in planar fashion. The result of this planar configuration is also better heat absorption and conveyance of heat into the interior of the new switch to the temperature-dependent switching mechanism.

In the case of the new method it is accordingly preferred if, in step a), the connector electrodes are punched out from a strip one next to another, integrally with the respective external terminal, the external terminals preferably being held on the strip by means of associated retaining webs.

This feature is advantageous in terms of manufacturing engineering because the geometrical association of the connector electrodes with one another is defined by the punching operation, and is maintained by the retaining webs during insert molding into the upper part. This exploits the fact that even after insert molding, the external terminals still project in any case out of the upper part, so that they can simultaneously serve to attach the connector electrodes to the strip. Once the connector electrodes have been embedded, they are detached from the strip and thus simultaneously from one another.

It is further preferred in the case of the new switch if each stationary contact is welded onto the associated connector electrode.

This feature is also advantageous in terms of manufacturing engineering, since once the connector electrode with pertinent external terminal has been punched out, all that is necessary in a following step is to weld on the stationary contact before the upper part is then insert molded. It is to be seen as a further advantage here that a part of the connector electrode is not pre-bent downward as the stationary contact, but rather that the connector electrode itself is maintained, in a manner of speaking, as a planar part, onto which the stationary contact is welded. This results, however, in unequivocal geometrical conditions: punching defects or bending of the connector electrode cannot cause any change in the position of the stationary contacts with respect to one another. Purely for the sake of completeness, it should be mentioned that the two stationary contacts preferably lie at approximately the same height so that the contact bridge reliably makes contact against both stationary contacts.

In general, it is preferred with the new switch if the lower part is configured in a disk shape and the upper part in a cup shape; and if the upper part overlaps the lower part at its rim in annular fashion, the lower part preferably being manufactured from metal.

The advantage here is that with the lower part manufactured from metal, good thermal contact between the new switch and the device to be protected results, while sufficiently good lateral electrical insulation is nevertheless achieved because of the cup-shaped upper part made of insulating material. Another result is good sealing of the housing from the outside, since the rim of the upper part which overlaps the lower part in annular fashion can be hot stamped or welded.

It is further preferred in this context if the lower part has on its rim an external circumferential groove, engaged with which is a ridge which is configured internally on the rim of the upper part.

The advantage here is that a snap connection, in a manner of speaking, results between the upper part and lower part, and simultaneously represents a kind of labyrinth seal which protects the interior of the housing from the entry of dirt, etc. This feature thus provides not only a very dust-tight seal for the housing, but moreover also allows for simple manufacture, since after the switching mechanism is in place, the upper part and lower part merely need to be snapped together in order to join all the parts of the switch to one another in captive fashion. The switch can then be transported in any desired manner to a welding or stamping station where the projecting rim is welded or stamped.

Further advantages are evident from the description and the appended drawings.

It is understood that the features mentioned above and those yet to be explained below can be used not only in the respective combinations indicated, but also in other combinations or in isolation, without leaving the context of the present invention.

BRIEF DESCRIPTION OF THE DRAWINGS

An embodiment of the invention is illustrated in the appended drawings and will be explained in more detail in the description below. In the drawings.

DETAILED DESCRIPTION OF A PREFERRED EMBODIMENT

Figure 1:
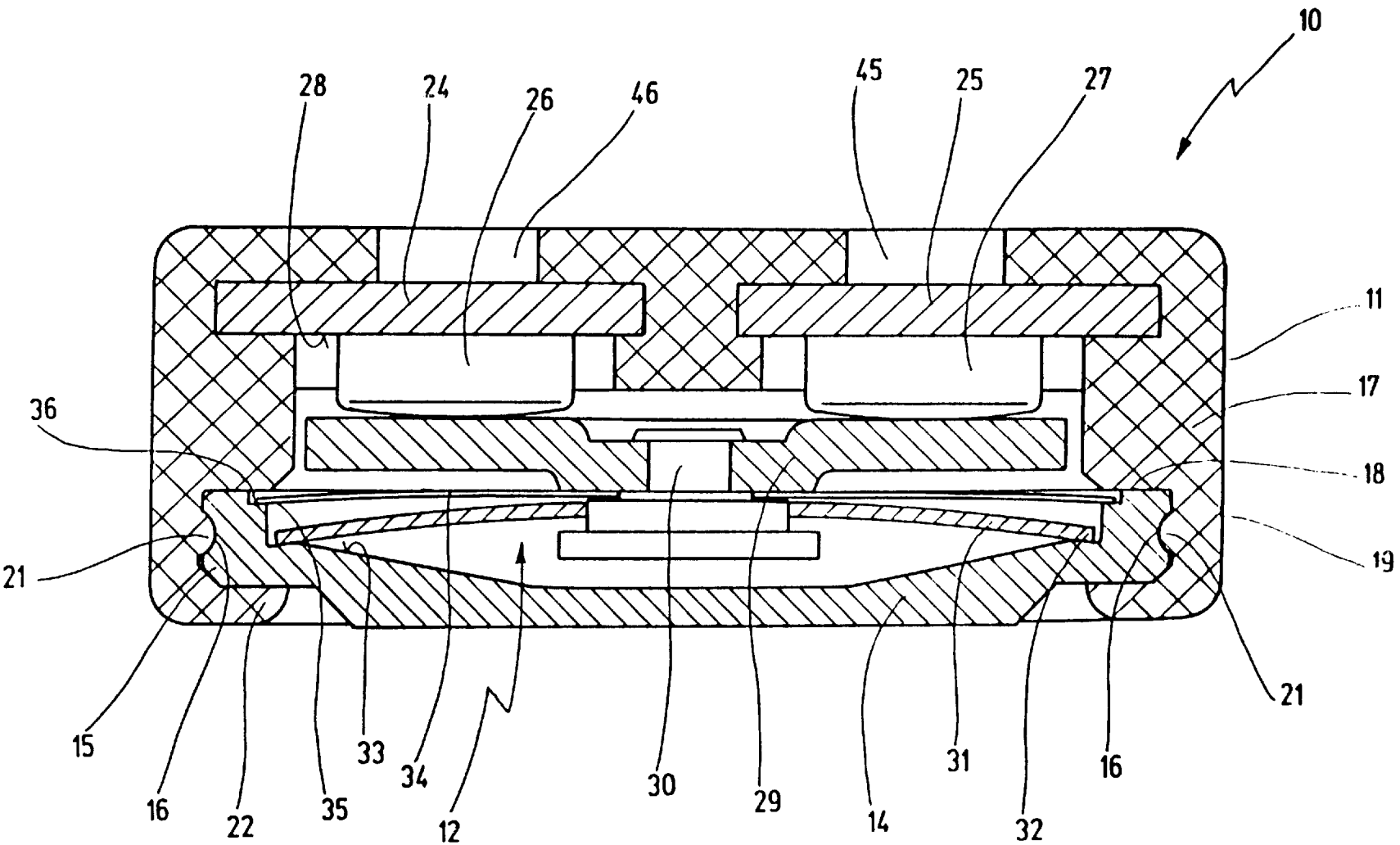
FIG. 1 shows a longitudinal section through the new switch along line I—I of FIG. 2.

In FIG. 1, 10 designates a temperature-dependent switch which has a housing 11 in which a temperature-dependent switching mechanism 12 is arranged.

Housing 11 comprises a disk-shaped lower part 14, on whose elevated rim 15 an external circumferential groove 16 is provided. A cup-shaped upper part 17 is braced with an inner shoulder 18 on elevated rim 15. Projecting beyond shoulder 18 is a rim 19 which is engaged with groove 16, by which means lower part 14 is snap-locked to upper part 17.

Rim 19 continues into an annular overlap 22 by means of which lower part 14 is further held on upper part 17. Said overlap 22 can be produced by stamping or welding a projecting region of rim 19.

While upper part 17 is manufactured from insulating material, lower part 14 can also be manufactured from insulating material or instead from metal, a lower part made of metal resulting in better thermal contact between switch 10 and a device to be protected.

Embedded into upper part 17 are two connector electrodes 24, 25, located next to one another, each of which carries a welded-on stationary contact 26, 27. The two stationary contacts 26, 27 are thus arranged on an inner side 28 of upper part 17.

Associated with the two stationary contacts 26, 27 is a current transfer member in the form of a movable contact bridge 29 which is joined by means of a rivet 30 to temperature-dependent switching mechanism 12. In known fashion, switching mechanism 12 comprises a bimetallic disk 31 which, in the switch position shown, is braced at its rim 32 against a floor 33 of lower part 14. Switching mechanism 12 further comprises a spring disk 34 which is guided peripherally with its rim 35 in a circumferential groove 36 which is configured between shoulder 18 and rim 15.

As a function of temperature, switching mechanism 12 brings contact bridge 29 into contact against the two stationary contacts 26, 27 or lifts them away from it. The exact function of the bimetallic switching mechanism is described in DE 26 44 411 C2 mentioned initially; the disclosure of this document being incorporated herewith by reference.

Figure 2:
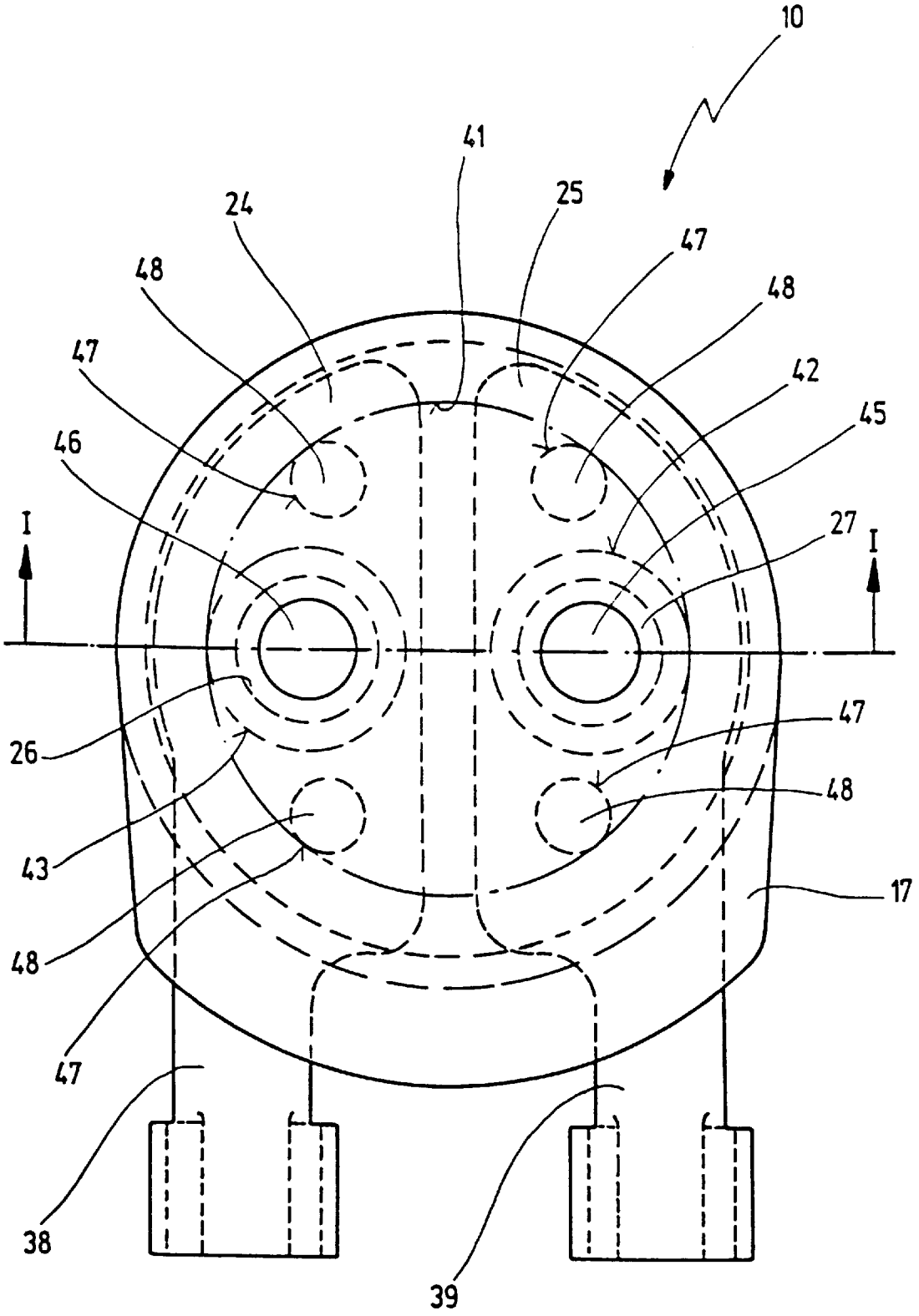
FIG. 2 shows a plan view of the switch from FIG. 1.

In the plan view of the new switch 10 shown in FIG. 2, it is evident that the two connector electrodes 24, 25 are joined integrally to external terminals 38, 39, which in the instance shown are provided as crimp terminals. When contact bridge 29 is in contact with the two stationary contacts 24, 25, the two external terminals 38, 39 are consequently connected in electrically conductive fashion to one another, and switch 10 is thus closed.

It is evident from FIG. 2 that an annular space 41 is provided in upper part 17 in order to receive switching mechanism 12, two receiving spaces 42 and 43 for stationary contacts 27 and 26, respectively, being provided on the floor of annular space 41 which corresponds to inner side 28.

Stationary contacts 26, 27 are moreover welded or soldered onto connector electrodes 24, 25. Remote from stationary contacts 26, 27, there are provided in upper part 17 two openings 45, 46, leading outward, by means of which on the one hand switch 10 is thermally coupled to a device to be protected; said openings can, on the other hand, be provided for test purposes, specifically in order to heat up the interior of switch 10 as quickly as possible by means of a hot plunger, and/or to make contact from outside with test probes to the two stationary contacts 26, 27, in order to test the operation of switch 10.

It is further evident from FIG. 2 that two holes 47 are provided in each connector electrode 24, 25, through which extend struts 48 of upper part 17, which are created when upper part is injection molded and ensure that connector electrodes 24, 25 sit nondisplaceably in upper part 17.

Figure 3A:
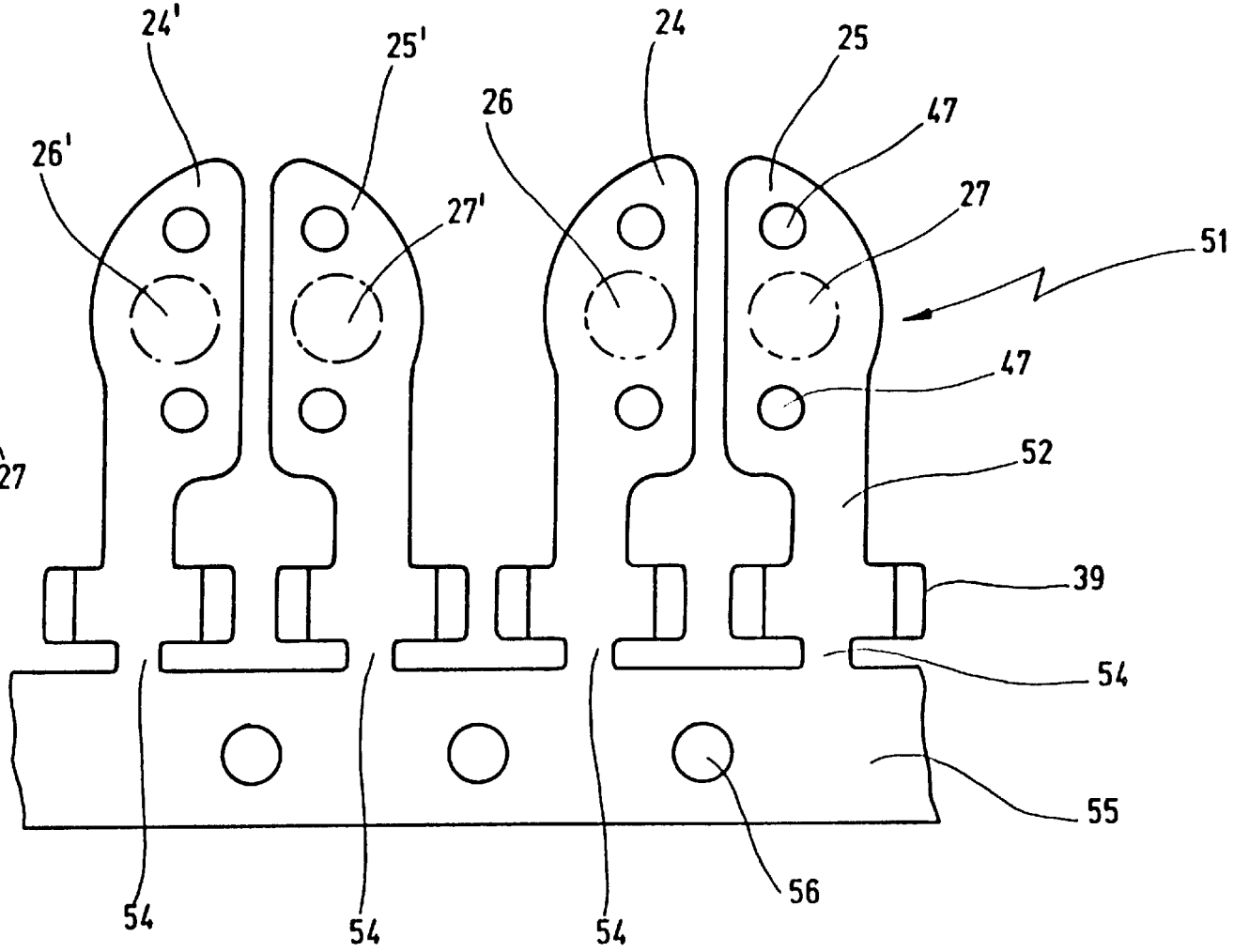
FIG. 3A shows a plan view of connector electrodes, arranged next to one another on a belt, for the switch from FIG. 1.

FIG. 3*a* shows the manner in which connector electrodes 24, 25 are delivered for the manufacture of an upper part 17. Connector electrodes 24, 25 and 24', 25' are associated with one another in pairs, and each have a blade-like head 51 which is joined integrally, via a narrowed web 52, to the respective external terminals 38 and 39. External terminals 38 and 39 are each, in turn, joined via a thin retaining web 54 to a strip 55 on which transport holes 56 are provided in order to advance strip 55.

Figure 3B:
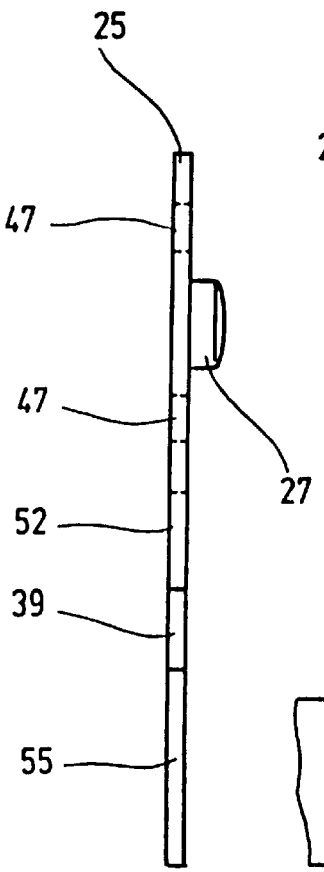
FIG. 3B shows a side view of a connector electrode from FIG. 3*a*.

The entire arrangement shown in FIG. 3*a* can, for example, be punched out of a sheet, whereupon stationary contacts 26, 27 are then welded on as shown in FIG. 3*b*. A cup-shaped upper part 17 is then injection molded around each pair of connector electrodes 24, 25 and 24', 25'. Once the molding compound has cured, retaining webs 54 are then cut through, thereby detaching upper part 17 from strip 55 and at the same time detaching the two electrodes 24, 25 from one another. As manufacture continues, switching mechanism 12 is then placed into upper part 17 or lower part 14, housing 11 is closed by snap-locking between upper part 17 and lower part 14, and lastly annular overlap 22 is produced by stamping or welding, openings 45, 46 serving to press upper part 17 down onto lower part 14. The manufacturing accuracy achieved by means of the pressure exerted in this fashion by the electrodes is better than if pressure were applied directly onto plastic regions of upper part 17, since dimensional accuracy there is poorer.

Therefore, what I claim, is:

1. A temperature-dependent switch, comprising:

a closed housing having a lower housing part and an upper housing part, said upper housing part made of electrically insulating material and having an inner side;

a temperature-dependent switching mechanism arranged within said housing;

two stationary contacts provided at the inner side of said upper housing part;

a current transfer member actuated by said temperature-dependent switching mechanism and cooperating with said stationary contacts so as to move between a first position unconnected to either of said two stationary contacts anda second position electrically connecting with each other as a function of temperature; and two connector electrodes embedded into said upper housing part, each connector electrode electrically connecting an associated one of said stationary contacts with a respective external terminal provided outside of said housing, and wherein each connector electrode is a flat metal part configured integrally with the respective external terminal.

2. A switch according to claim 1, wherein said external terminal projects laterally from the upper housing part.

3. A switch according to claim 1, wherein the connector electrodes lie parallel to one another in the upper housing part.

4. A switch according to claim 1, wherein each stationary contact is welded onto the associated connector electrode.

5. A switch according to claim 1, wherein the lower housing part is configured in a disk shape and the upper housing part in a cup shape, the upper housing part overlapping the lower housing part at its rim in annular fashion.

6. A switch according to claim 5, wherein the lower housing part is manufactured from metal.

7. A temperature-dependent switch, comprising:

a closed housing having a lower housing part and an upper housing part, said upper housing part made of electrically insulating material and having an inner side, said lower housing part being manufactured from metal;

a temperature-dependent switching mechanism arranged within said housing;

two stationary contacts provided at the inner side of said upper housing part;

a current transfer member actuated by said temperature-dependent switching mechanism and cooperating with said stationary contacts such as to electrically connect said stationary contacts with each other as a function of temperature; and two connector electrodes embedded into said upper housing part, each connector electrode electrically connecting an associated one of said stationary contacts with a respective external terminal provided outside of said housing, wherein the lower housing part is configured in a disk shape and the upper housing part in a cup shape, the upper housing part overlapping the lower housing part at its rim in annular fashion, and wherein the lower housing part has on its rim an external circumferential groove, engaged with a ridge which is configured internally on the rim of the upper housing part.

* * * * *

UNITED STATES PATENT AND TRADEMARK OFFICE

CERTIFICATE OF CORRECTION

PATENT NO. : 6,100,784
DATED : August 8, 2000
INVENTOR(S) : Marcel Hofsäss

It is certified that error appears in the above-identified patent and that said Letters Patent is hereby corrected as shown below:

Title page,
Under item "[30] Foreign Application Priority Data", "Jan. 3, 1997" should be -- Mar. 1, 1997 --.

Signed and Sealed this

Nineteenth Day of March, 2002

*Attest:*

*Attesting Officer*

JAMES E. ROGAN
*Director of the United States Patent and Trademark Office*